United States Patent [19]

Harris

[11] 4,339,308

[45] Jul. 13, 1982

[54] MULTI-CELL EMISSION CONTROL SYSTEM

[75] Inventor: Morton E. Harris, Bloomfield Hills, Mich.

[73] Assignee: The Mercier Corporation, Birmingham, Mich.

[21] Appl. No.: 220,851

[22] Filed: Dec. 29, 1980

[51] Int. Cl.[3] ..... C10B 33/00; C10B 33/12; C10B 41/00

[52] U.S. Cl. ..... 202/263; 202/270

[58] Field of Search ..... 202/263, 270; 266/157–159; 414/212

[56] References Cited

U.S. PATENT DOCUMENTS

| | | | |
|---|---|---|---|
| 3,716,457 | 2/1973 | Schon | 202/263 |
| 3,746,626 | 7/1973 | Morrison | 202/263 |
| 3,843,459 | 10/1974 | Krenke | 202/263 |
| 3,844,901 | 10/1974 | Roe et al. | 202/263 |
| 3,937,656 | 2/1976 | Pries et al. | 202/263 |
| 3,945,308 | 3/1976 | Jakimowicz et al. | 202/263 |
| 4,146,435 | 3/1979 | Veno et al. | 202/263 |
| 4,238,292 | 12/1980 | Stog | 202/263 |

*Primary Examiner*—Bradley Garris

*Attorney, Agent, or Firm*—Harness, Dickey & Pierce

[57] ABSTRACT

An apparatus for controlling gaseous and particulate effluent emissions from an aligned row of plural reactors operable to intermittently discharge a reaction mass comprising a three-dimensional enclosure disposed along the discharge sides of the reactors and subdivided into at least two cells by transverse partitions each having the upper collection zone thereof connected by means of a valved inlet port to a central exhaust duct for withdrawing effluents therefrom. The valve in each inlet port is movable from a substantially closed standby position to a substantially open exhaust position during a discharge operation of a reaction mass from a reactor disposed within a particular cell while the exhaust blower in the central duct simultaneously is energized from a standby operation to a full exhaust operation during the reactor discharge operation and return to the standby condition at the conclusion of the discharge step. The central exhaust duct preferably incorporates a branch disposed at selected secondary positions exteriorly of the enclosure for entrapping and withdrawing effluents emitted from other sections of the reactors.

6 Claims, 4 Drawing Figures

MULTI-CELL EMISSION CONTROL SYSTEM

BACKGROUND OF THE INVENTION

The present invention is particularly applicable but not necessarily restricted to an apparatus for controlling gaseous and particulate emissions from a battery of aligned by-product coke ovens during the push or intermittent discharge of the coke product from a selected oven in the row.

A variety of emission control systems have heretofore been proposed or used in connection with such by-product coke oven batteries and have achieved a substantial reduction in the exhaust effluent discharged into the atmosphere. Typical of such prior art systems are those shown and described in U.S. Pat. Nos. 3,367,844; 3,630,852; 3,647,636; 3,676,305; 3,715,282; 3,716,457; 3,746,626 and 3,844,901. The emission control systems disclosed in the aforementioned United States patents include the use of a side-shed enclosure for containing the emissions during the push of coke from an oven which are exhausted through an exhaust duct and treated prior to discharge to the atmosphere. In certain of the embodiments disclosed, the car or carriage into which the coke is discharged is itself provided with a hood for containment of the exhaust effluents in still other embodiments disclosed in the aforementioned patents, the coke car or carriage incorporates some of the closure structure which is movable therewith and also incorporates actuating devices on the coke car for selectively opening exhaust means in the vicinity of the coke car. A continuing problem associated with such prior art emission control systems is the general complexity and the high capital investment necessary to install such systems and the maintenance associated in the proper operation thereof to provide efficient emission control. The high temperature and particulate matter of the effluent has also occasioned premature failure necessitating frequent maintenance of mechanisms associated with such emission control systems further contributing toward high operating costs. Additionally, such prior art systems are somewhat energy intensive in providing for efficient emission control also contributing toward high operational costs.

The improved emission control system of the present invention overcomes many of the problems and disadvantages associated with prior art systems in providing a simple structure which achieves a concentration of the gaseous and particulate effluent in localized sections of the system at which a discharge operation is being performed and which simultaneously concentrates the exhaust capability in that section to achieve efficient withdrawal of the effluent for further treatment prior to harmless discharge to the atmosphere. In so doing, the emission control system of the present invention is less energy intensive, is simpler to control, is of increased efficiency in operation, is of economical construction and maintenance, and can readily be adapted for installation on a variety of reactors arranged transversely in aligned rows such as by-product coke ovens.

SUMMARY OF THE INVENTION

The benefits and advantages of the present invention are achieved by an apparatus which is effective to control the emissions of gaseous and particulate effluents from an aligned row of plural transverse reactors which are positioned on a base or on the ground wherein the reactors have discharge doors or ports at one end thereof from which a reaction mass is intermittently discharged into a carriage movable along the aligned discharged ends of the reactors. The apparatus includes a three-dimensional enclosure extending along the discharge ends of the reactors including a generally upright first wall having its lower edge portion disposed in substantially gas sealing relationship on the upper edges of the reactors, a generally upright second wall spaced outwardly from the first wall and having its lower edge spaced upwardly from the base, a roof panel connecting the first and second walls at a position above the reactors, a pair of end walls connecting the first, second and roof walls and at least one intermediate wall extending transversely between the first and second and roof walls dividing the enclosure into a plurality of cells. A central duct including a plurality of inlet ports extends along the enclosure with one inlet port disposed in communication with each cell at a position adjacent to the underside of the roof wall. Each inlet port is formed with valve means which is selectively positionable to and from a substantially closed standby condition and an open exhaust condition. The duct is connected to an exhaust including a blower which is operable at a low standby capacity and a high exhaust capacity for withdrawing effluent through each of the inlet ports. The system incorporates a control for moving the valve means in an inlet port of a selected cell in which a discharge operation is being performed from the standby position to the exhaust position and for simultaneously activating the exhaust blower from the standby to the exhaust capacity for at least the duration of the discharge operation. At the conclusion of the discharge operation, the valve and the blower are again returned to the standby position at which residual effluent accumulating within the cells is withdrawn pending a subsequent discharge operation.

In accordance with a further preferred embodiment of the present invention, the central duct includes an auxiliary section which is positionable longitudinally above the upper portions of other sections of the reactors for withdrawing any effluents which may be emitted from such sections.

Additional benefits and advantages of the present invention will become apparent upon a reading of the description of the preferred embodiments taken in conjunction with the accompanying drawings.

BRIEF DESCRIPTION OF THE DRAWINGS

FIG. 3 is a fragmentary transverse vertical sectional view through apparatus illustrated in FIG. 2 and taken substantially along the line 3—3 thereof.

DESCRIPTION OF THE PREFERRED EMBODIMENTS

Figure 1:
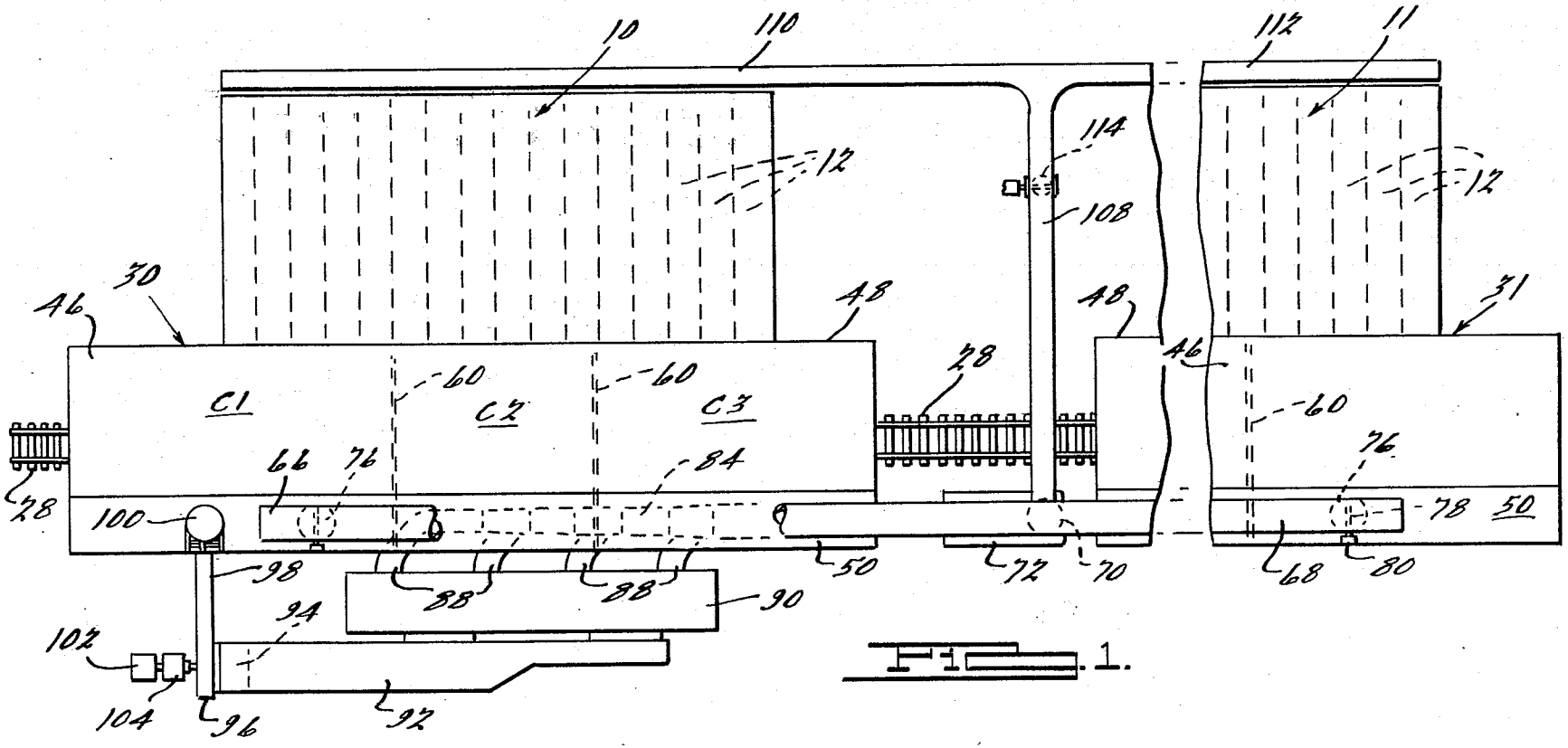
FIG. 1 is a fragmentary plan view of an emission control apparatus constructed in accordance with the preferred embodiments of the present invention and disposed adjacent to two longitudinally spaced by-product coke batteries.

Referring now in detail to the drawings, the multi-cell emission control system of the present invention is illustrated in association with two by-product coke batteries indicated at 10 and 11 in FIG. 1 disposed in longitudinally spaced aligned relationship each comprising a plurality of individual coke ovens 12 disposed in transverse aligned relationship. In accordance with conventional practice, each coke oven 12 is provided with a removable door 14 as shown in FIG. 3 to provide access for a ram 16 as fragmentarily shown in dotted lines to effect a discharge of the coke product from the discharge or coke side of the oven which similarly is provided with a removable door 18. An elevated platform or bench 20 which extends along the discharge side of the battery including tracks on which a coke guide car 22 is movably mounted and includes a rectangular guide chute 24 open at each end for receiving the reaction mass or coke discharged from an oven for guiding the mass into a quench car 26 positioned on tracks 28 disposed on a base at ground level adjacent to the coke guide car. At the conclusion of a coke push or discharge operation, the quench car is subsequently transferred to a quenching tower in accordance with conventional practice.

The foregoing arrangement and structural features are conventional in by-product coke oven battery constructions of the type well known in the art. In typical operation of a coke battery, each oven is sequentially filled with a charge of fresh coal which is heated for a preselected coking period after which the push and discharge doors are removed and the coke guide car placed in alignment with the discharge port and the ram progressively pushes the coke into the receiving quench car which travels slowly to distribute the reaction mass along the length thereof. During the push or discharge operation, the hot coke upon coming in contact with the surrounding atmosphere causes a surge of gaseous and particulate effluents to be evolved which are confined and processed in accordance with the emission control system of the present invention in a manner as more fully hereinafter described. It will be appreciated that while the emission control system of the present invention is herein disclosed in connection with a coke oven battery, it will be appreciated that the principles of the present invention are equally applicable for controlling emissions from any aligned series of plural transverse reactors from which a reaction mass is sequentially and intermittently discharged.

Figure 2:
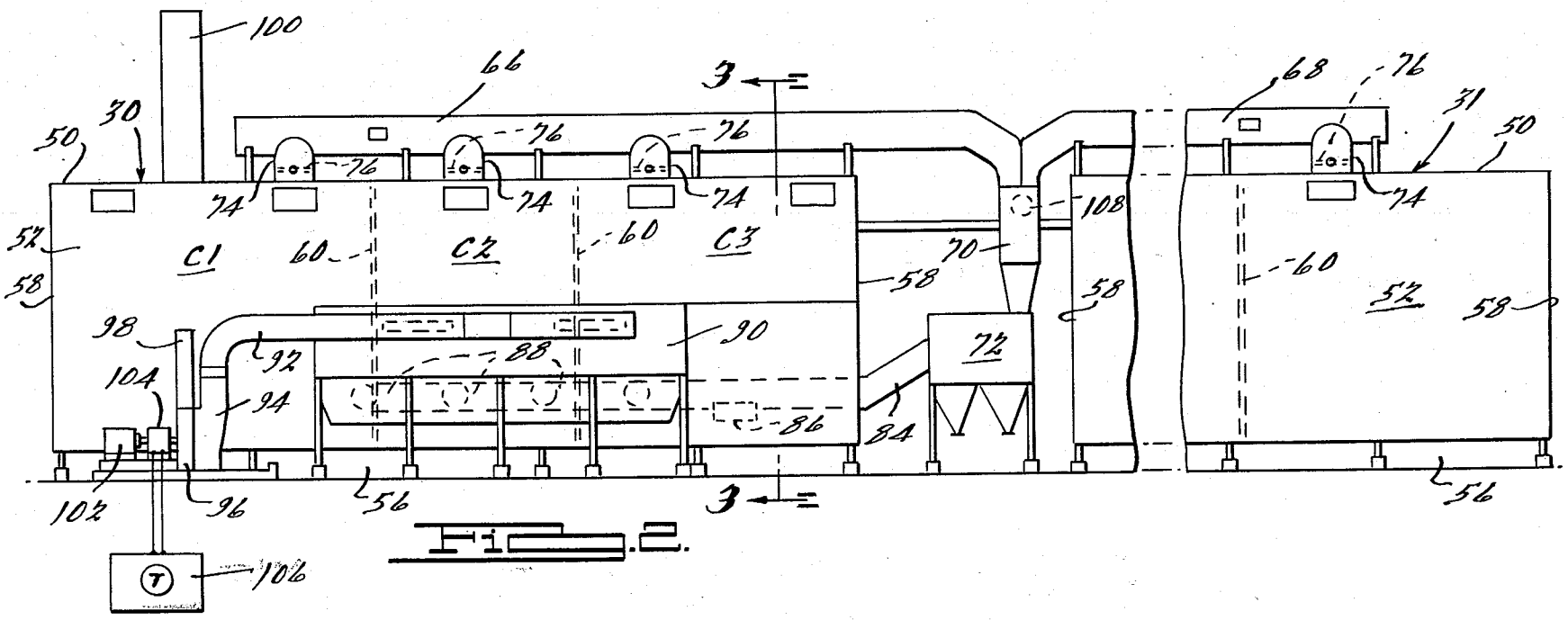
FIG. 2 is a fragmentary side elevational view of the arrangement illustrated in FIG. 1.
Figure 2:
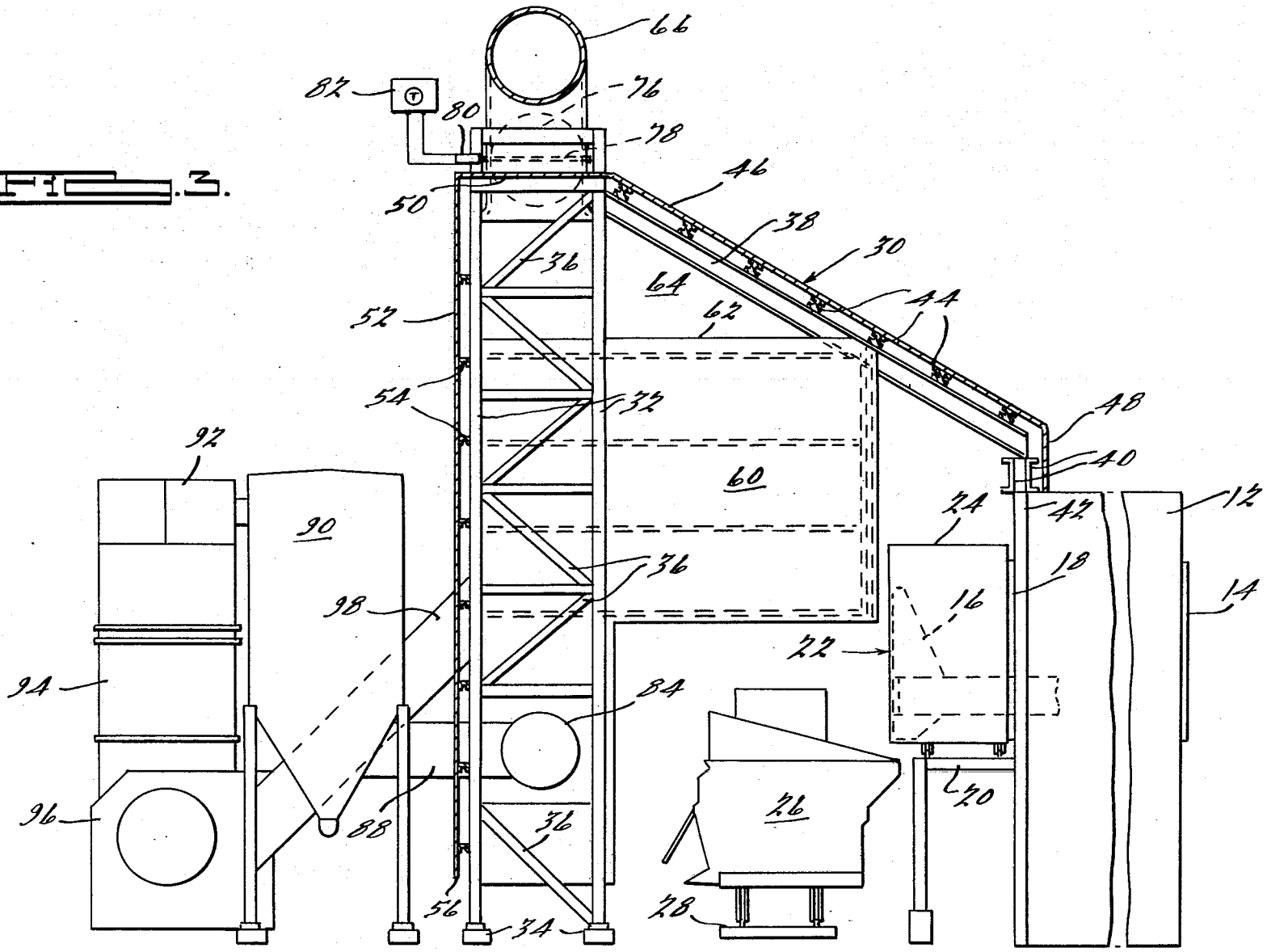

In the exemplary embodiment as illustrated in FIGS. 1 and 2, the emission control system of the present invention is provided with an emissions confinement enclosure 30 extending longitudinally along the discharge side of the coke oven battery 10 and an emissions confinement enclosure 31 extending along the discharge side of the battery 11. It will be appreciated that the system of the present invention may comprise only one emissions confinement enclosure or may include three or more, as the case may be, depending upon the particular arrangement of the plural transverse reactors. As may be best seen in FIG. 3, the emissions confinement enclosure comprises a framework consisting of a series of pairs of upright support members 32 spaced outwardly of the coke oven battery and quench car 26 which are supported at their lower ends by foundation pads 34 and are rigidified by an angular truss-type construction including angular members 36. A plurality of transversely spaced angularly inclined roof beams 38 are secured to the upper portion of the uprights 32 of the framework and have their lower ends supported by longitudinally extending channel members 40 supported on vertical buck stays 42. A plurality of longitudinally extending I-beam stringers 44 are secured and extend along the upper edges of the roof beams 38 to the outer flange of which a roof panel or wall 46 is secured which extends angularly downwardly toward the upper edge of the discharge end of the coke oven battery. The roof wall 46 terminates in a downwardly extending wall section 48 having its lower edge disposed in substantially gas-tight sealing relationship with the upper edge of the coke oven battery. The roof wall 46 includes a horizontal section 50 which extends above the framework and terminates in sealing engagement with the upper edge of an outer wall 52 affixed to a series of longitudinally extending channel stringers 54 affixed to the side of the outermost upright 32. The outer wall 52 terminates at its lower end in an edge which is spaced upwardly from the base or ground on which the structure is supported forming an air inlet or gap indicated at 56 in FIGS. 2 and 3 for admittance of outside air into the interior of the enclosure.

Figure 4:
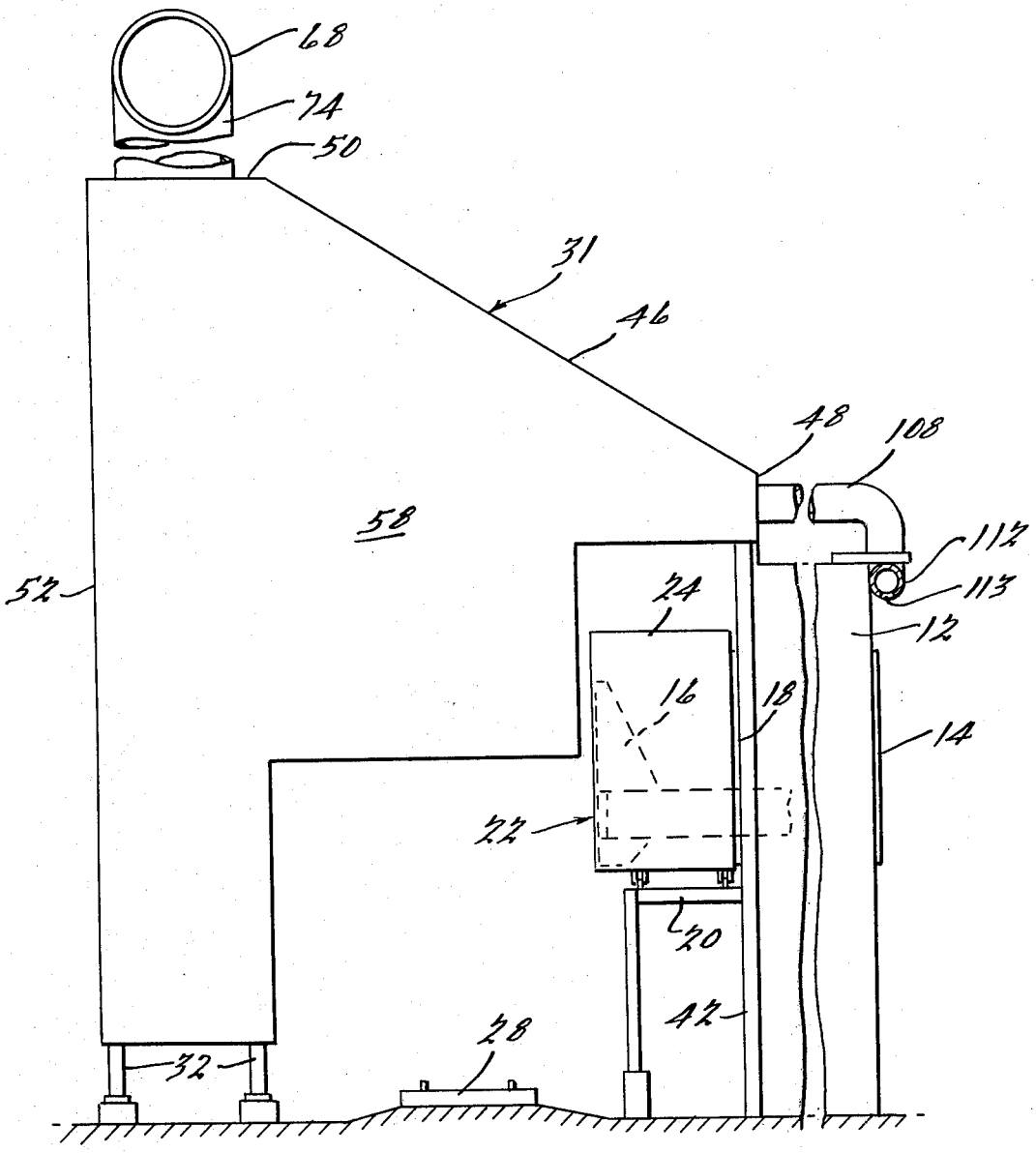
FIG. 4 is a fragmentary elevational view of the right hand end of the apparatus as viewed in FIG. 2.

Each end of each of the emissions confinement enclosures is provided with an end wall 58 as best seen in FIG. 4 connected along its edges to the outer wall, roof walls and wall section and which is recessed in a stepwise configuration to provide for clearance access of the coke guide car 22 and the quench car. Each emissions confinement enclosure is also provided with at least one transverse wall as best shown in FIG. 3 for subdividing the interior of the enclosure into a plurality of individual cells indicated at C1, C2 and C3 of enclosure 30 in FIGS. 1 and 2. The transverse wall 60 as shown in FIG. 3 extends from the outer wall 52 toward the wall section 48 and similarly is notched along its lower and inner edges to provide for clearance access of the coke guide car 22 and quench car 26. The inner upper edge of the transverse wall 60 is supported by the roof beams 38 and the upper portion terminates in an edge 62 which is spaced downwardly from the roof wall 30 providing a triangular shaped port 64 providing communication between adjacent cells at the upper portions thereof.

In accordance with the foregoing construction it is apparent that each of the cells C1–C3 of the enclosure 30 defines along the upper portion thereof a collection zone for the gaseous and particulate emissions evolved during a push or discharge operation of an individual coke oven located within that particular cell. The construction of the framework including the uprights 32 and truss members 36 also provides for a self-supporting structure such that the roof wall 46 and roof beams 38 are cantilevered and impose only a low downward force on the upper edges of the coke oven battery.

The subdivision of each enclosure into a plurality of cells serves to concentrate the emissions within a relatively smaller volumetric chamber from which it can be effectively removed by a central exhaust system specifically activated to exhaust that particular cell. Any excessive emissions beyond the capacity of a particular cell can spill over through the triangular port 64 into an adjacent cell for evacuation thereby.

The exhaust system comprises an overhead duct extending longitudinally above the horizontal section of the roof wall and supported by the framework and includes a branch 66 above the enclosure 30 and a branch 68 above the enclosure 31. The two branches are joined and connected to a downcomer 70 as best seen in FIG. 2 which is disposed in communication with the inlet of a hoppered spark arresting chamber 72. Each branch duct is provided with a plurality of inlet ducts 74 extending downwardly therefrom and through the horizontal section of the roof wall and in communication with the upper collection zone of each individual cell. Each inlet duct is provided with a valve such as rotatable butterfly valve 76 supported on a shaft 78 as best seen in FIG. 3 which in turn is connected to a motorized drive member 80 such as a fluid actuated cylinder for rotating the valve between a substantially closed standby position to a substantially open exhaust position in which the valve member is positioned in a vertical direction as indicated by the dotted lines in FIG. 3. The valve 76 when in the closed or standby position is disposed or designed so as to provide a residual opening of about 5 to 15% to maintain continued communication with the upper zone of a cell assuring exhausting of any residual accumulation of effluent therein. The partial open condition of the valve 76 assures a continuous sweep of fresh air upwardly through each cell during intervals between discharge or push operations sweeping any emissions that may occur as a result of leakage of gases around the doors 18 of the coke oven battery. The partial opening of the valve 76 also provides for exhausting of any spillover of effluent from an adjacent cell through the triangular port 64 during a push operation in such adjacent cell.

The operation of the motor drive 80 of each valve is independently controlled and can be manually or automatically actuated through a remote control system diagramatically indicated at 82 in FIG. 3 connected to each motor so as to effect a movement of the valve from the standby position to the fully open exhaust position during a discharge operation within that particular cell. Such control system may suitably include a timer for providing a preselected dwell period corresponding to or slightly longer than the time required for an average discharge operation to effect substantially complete removal of the gaseous and particulate effluent before returning the valve back to the standby condition. During the operation of a particular valve in a cell undergoing a discharge operation, the remaining valves of the other cells are retained in the standby position whereby the maximum exhaust capacity is concentrated in the cell in which the emissions are evolved thereby achieving maximum efficiency in their recovery and extraction.

The recovered emissions pass through the branch duct and through the spark arrester 72 for removing any glowing particulate matter after which the effluent passes through a duct 84 extending through the lower portion of the framework in which some dilution with outside air through a damper 86 can be effected to provide for a further reduction in the temperature of the gases. The duct 84 is provided with a plurality of side branches 88 as best seen in FIG. 1 which enter a filter chamber or bag house 90 of a type conventional in the art. The particulate matter is extracted in the bag house and the substantially purified effluent passes from the upper portion of the bag house through a plenum 92 into a transition piece 94 as shown in FIG. 2 disposed in communication with the suction side of an exhaust blower 96. The discharge side of the blower 96 is connected by means of an angular duct 98 which extends upwardly therefrom and is disposed in communication with an exhaust stack 100 as best seen in FIG. 2 which extends above the enclosure 30 for discharging the purified effluent harmlessly to the atmosphere.

The exhaust blower 96 is drivingly connected to a motor 102 as best seen in FIGS. 1 and 2 by means of an eddy current clutch 104 which as shown in FIG. 2 is connected to a control system 106 preferably also including a timer for energizing the clutch so as to cause the blower to accelerate from a standby position to a high speed exhaust position for increasing the volumetric rate of gases withdrawn through the exhaust system during such periods when a coke push or discharge operation is being performed in a particular cell. When in the standby condition, the operation of the blower 96 is sufficient with all of the valves 76 in the inlet ducts in the substantially closed position to effect a low capacity continuous withdrawal of gases from all of the cells. During a discharge or coke push operation, accompanied by an opening of an exhaust valve 76 in the cell in which a discharge operation is being performed, an acceleration of the blower to the full capacity exhaust condition effects a rapid removal of emissions from that cell and a small increase of gases from the remaining cells including those adjacent to the cell undergoing a discharge operation. The period of energization of the eddy current clutch may be controlled by a timer associated with the timer of the control system 82 for individually controlling the exhaust valves which can be achieved automatically or manually in accordance with techniques well known in the art. By virtue of the blower being in a standby condition during time periods intervening discharge operations, a substantial reduction in power requirements for driving the blower are achieved with a corresponding reduction in wear on the operating components.

In accordance with a preferred embodiment of the present invention, the central exhaust system is further provided with an auxiliary duct 108 as best seen in FIGS. 1, 2 and 4 which is disposed in communication with the downcomer 70 and extends laterally to a position adjacent the push or outer edges of the battery of coke ovens and is connected to branch ducts 110,112 which extend longitudinally along the upper edges of battery 10 and battery 11 respectively. Each branch duct such as the branch duct 112 as best shown in FIG. 4 is provided with a series of slots or openings 113 in the underside thereof so as to withdraw any emissions that may leak from around the edges of the doors 14 along the push side of the battery. The auxiliary duct 108 as diagrammatically shown in FIG. 1 can be provided with a valve 114, if desired, which is operable to close reducing gases withdrawn from the branch ducts 110, 112 during a discharge operation in a cell when the blower is in the full exhaust condition thereby further maximizing withdrawal of emissions from such cell.

While it will be apparent that the preferred embodiments of the invention disclosed are well calculated to fulfill the objects above stated, it will be appreciated that the invention is susceptible to modification, variation and change without departing from the proper source or fair meaning of the subjoined claims.

What is claimed is:

1. In an apparatus for controlling emissions to the atmosphere of gaseous and particulate effluents from an aligned row of plural transverse reactors disposed on a base each having a port in the discharge end thereof for intermittently discharging a reaction mass therefrom and a carriage movable along the aligned discharge ends for receiving the reaction mass, the improvement comprising a three-dimensional enclosure extending along the discharge end of the reactors including a generally upright first wall having a lower portion disposed in substantially gas sealing relationship on the discharge end portion of the reactors, a generally upright second walls spaced outwardly from the first wall having a lower edge thereof spaced upwardly from the base, a roof panel connecting said first and second walls at a position above the reactors, a pair of end walls connecting said first, second and roof walls; and at least one intermediate wall extending transversely between said first and second and roof walls dividing said enclosure into a plurality of cells, said intermediate wall formed with an opening adjacent to said roof wall for providing communication between the upper portions of adjacent cells, said enclosure including a framework for supporting said roof wall and first wall in a substantially cantilevered fashion above the discharge ends of the reactors, central duct means including a plurality of inlet ports each disposed in communication with a cell at a position adjacent to the underside of said roof wall, at least a portion of said roof wall angularly inclined upwardly defining an upper collection zone for the effluent and disposed in communication with said inlet port, valve means in each inlet port positionable to and from a substantially closed standby position and an open exhaust position, exhaust means connected to said duct means operable at a low standby capacity and a high exhaust capacity for withdrawing effluent from said cells, said duct means including extraction means for extracting particulate matter from the exhausted effluent, and means for moving said valve means in an inlet port of a selected cell in which a discharge operation is being performed from said standby to said exhaust position and for activating said exhaust means from said standby to said exhaust capacity for at least the duration of said discharge operation and back to said standby position and standby capacity at the conclusion thereof, said valve means when in said standby position disposed in a partially open position to continuously exhaust any effluent accumulation within each cell between successive discharge operations.

2. The apparatus as defined in claim 1 further characterized in that each of the reactors has a second end opposite the discharge end formed with a second port and said duct means includes a section extending longitudinally above the upper portions of the second port and provided with second inlet ports for withdrawing any effluent emitted from the second ports.

3. The apparatus as defined in claim 1 in which said extraction means comprises a filter.

4. The apparatus as defined in claim 1 in which said exhaust means comprises a blower and motor means drivingly coupled to said blower, an eddy current clutch interposed between said motor means and said blower, said clutch selectively energizable for activating said blower from said standby to said exhaust capacity.

5. The apparatus as defined in claim 1 in which said valve means when in said standby position is about 5 to 15% open.

6. The apparatus as defined in claim 1 further including control means including timing means for maintaining said valve means and said exhaust means in said exhaust position and exhaust capacity, respectively, for a selected time period.

* * * * *

UNITED STATES PATENT AND TRADEMARK OFFICE

CERTIFICATE OF CORRECTION

PATENT NO. : 4,339,308

DATED : July 13, 1982

INVENTOR(S) : Morton E. Harris

It is certified that error appears in the above—identified patent and that said Letters Patent is hereby corrected as shown below:

Column 7, line 1 - "walls" should be --wall--

Column 7, line 27 - "an" should be --said--

Signed and Sealed this

*Twenth-eighth* Day of *September 1982*

[SEAL]

*Attest:*

GERALD J. MOSSINGHOFF

*Attesting Officer* *Commissioner of Patents and Trademarks*